US005536426A

United States Patent [19]

Sasaki et al.

[11] Patent Number: 5,536,426

[45] Date of Patent: Jul. 16, 1996

[54] ELECTRORHEOLOGICAL FLUID CONTAINING CARBONACEOUS PARTICLES

[75] Inventors: Makoto Sasaki; Yukio Kobayashi; Katsuhiko Haji, all of Yokohama, Japan

[73] Assignee: Nippon Oil Company, Ltd., Tokyo, Japan

[21] Appl. No.: 243,998

[22] Filed: May 18, 1994

[30] Foreign Application Priority Data

| | | | |
|---|---|---|---|
| May 21, 1993 | [JP] | Japan | 5-142749 |
| Aug. 25, 1993 | [JP] | Japan | 5-232406 |
| Dec. 14, 1993 | [JP] | Japan | 5-342385 |

[51] Int. Cl.[6] ..... C10M 171/00; C10M 169/04

[52] U.S. Cl. ..... 252/73; 252/74; 252/75; 252/77; 252/572

[58] Field of Search ..... 252/73, 572, 76, 252/75, 77, 74

[56] References Cited

U.S. PATENT DOCUMENTS

| | | | |
|---|---|---|---|
| 3,047,507 | 7/1962 | Winslow | 252/75 |
| 5,087,382 | 2/1992 | Ishino et al. | 252/73 |
| 5,266,229 | 11/1993 | Tomizawa et al. | 252/73 |
| 5,332,517 | 7/1994 | Torii et al. | 252/73 |

FOREIGN PATENT DOCUMENTS

| | | |
|---|---|---|
| 0361106 | 4/1990 | European Pat. Off. . |
| 0406853 | 1/1991 | European Pat. Off. . |
| 0516394 | 12/1992 | European Pat. Off. . |
| 0548956 | 6/1993 | European Pat. Off. . |
| 51-33783 | 3/1976 | Japan . |
| 53-93186 | 7/1978 | Japan . |
| 58-179259 | 10/1983 | Japan . |
| 61-44998 | 3/1986 | Japan . |
| 62-95397 | 5/1987 | Japan . |
| 3-47896 | 2/1991 | Japan . |
| 5-193919 | 8/1993 | Japan . |
| 1154209 | 8/1965 | United Kingdom . |
| 1076754 | 7/1967 | United Kingdom . |

OTHER PUBLICATIONS

Haraoka Takuji—Production of Carbonaceous Powder For Electroviscous Fluid—Pat. No. A5193919, vol. 17, No. 627, Aug. 3, 1993—Patent Abstracts of Japan.

New Electro–Viscous Fluid Used For Electrical Controls—JP63097694 Asahi Chemical Ind. KK. Apr. 28, 1988—Abstracts.

*Primary Examiner*—Christine Skane

*Attorney, Agent, or Firm*—Armstrong, Westerman, Hattori, McLeland & Naughton

[57] ABSTRACT

An electrorheological fluid comprising an electrically insulating liquid and acid, iodine or alcohol-treated, or iodine-treated and subsequently electrically insulating film-coated, dispersible carbonaceous particles dispersed therein has a high electrorheological effect even without lowering in a high temperature region, though it is a water-free system.

3 Claims, No Drawings

ELECTRORHEOLOGICAL FLUID CONTAINING CARBONACEOUS PARTICLES

BACKGROUND OF THE INVENTION

1. Field of the Invention

The present invention relates to an water-free, electrorheological fluid capable of controlling the viscosity by application of an electric field.

2. Prior Art

An electrorheological fluid is a suspension comprising an electrically insulating liquid and inorganic or polymeric particles dispersed therein, whose viscosity is rapidly and reversibly changed by applying an electric field to the fluid, for example, from a liquid state to a plastic state or a solid state and vice versa. This phenomenon is called Winslows' effect.

Generally, particles whose surfaces can be readily polarized by application of an electric field are used as dispersible particles. As inorganic dispersible particles, silica is disclosed in U.S. Pat. No. 3,047,507; British Patent No. 1,076,754; and Japanese Patent Application Kokai (Laid-open) No. 61-44998, and zeolite is disclosed in Japanese Patent Application Kokai (Laid-open) No. 62-95397. As polymeric dispersible particles, alginic acid, carboxyl-containing glucose and sulfone-containing glucose are disclosed in Japanese Patent Application Kokai (Laid-open) No. 51-33783; divinylbenzene-cross-linked polyacrylic acid is disclosed in Japanese Patent Application Kokai (Laid-open) No. 53-93186; and resol-type phenol resin is disclosed in Japanese Patent Application Kokai (Laid-open) No. 58-179259.

Mineral oil, silicone oil, fluorocarbon oil, halogenated oil, etc. are known as an electrically insulating oil.

In the above-mentioned prior art it is necessary that water is adsorbed on the surfaces of dispersed particles to enhance the electrorheological effect, and thus a small amount of water is contained in the electrorheological fluid.

Mechanism of increasing the viscosity of an electrorheological fluid by application of an electric field thereto can be clarified according to the electrical double layer theory. That is, an electrical double layer is formed on the surfaces each of dispersed particles in an electrorheological fluid, and when no electric field is applied to the electrorheological fluid, the particles are repelled from one another on their surfaces and are never brought into an alignment of dispersed particles. When an electric field is applied thereto, an electrical deviation takes place on the electrical double layers of the dispersed particles, and the dispersed particles are aligned by an electrostatic attractive force to form a bridge of dispersed particles. Thus, the viscosity of the fluid is increased, sometimes resulting in solidification. The water contained in the electrorheological fluid promotes to form the electrical double layers.

The electrorheological fluid is expected to be used in engine mounts, shock absorbers, clutch, etc.

In the prior art, the presence of water is required for obtaining a satisfactory electrorheological effect, and thus there are still some problems due to the presence of water. One of the problems is a short circuit due to the easy current passage at an elevated voltage. Another problem is a limited applicable temperature range due to the reduced electrorheological effect by solidification of water into ice at 0° C. or lower, or by evaporation of water at 100° C. or higher. These problems have been main factors of preventing practical application of the electrorheological fluid.

A water-free electrorheological fluid based on fine carbon particles is disclosed in Japanese Patent Application Kokai (Laid-open) 3-47896, but has a low electrorheological effect, because the fine carbon particles so far used is only the heat-treated one.

SUMMARY OF THE INVENTION

An object of the present invention is to provide a water-free electrorheological fluid containing carbonaceous particles and having a high electrorheological effect and a less current passage, i.e. no possibility for a short circuit, in spite of the water-free system, the effect being not lowered even in a low temperature region at not more than 0° C. and in a high temperature region at not less than 100° C.

As a result of extensive studies, the present inventors have found a solution of the problems by using specific acid or specific compound treated carbonaceous particles as dispersible particles and have established the present invention.

That is, according to a first aspect of the present invention, there is provided an electrorheological fluid, which comprises an electrically insulating liquid and inorganic or organic acid-treated carbonaceous particles dispersed in the liquid.

According to a second aspect of the present invention there is provided an electrorheological fluid, which comprises an electrically insulating liquid and iodine-treated carbonaceous particles dispersed in the liquid.

According to a third aspect of the present invention there is provided an electrorheological fluid, which comprises an electrically insulating liquid and iodine-treated and subsequently electrically insulating film-coated dispersible carbonaceous particles dispersed in the liquid.

According to a fourth aspect of the present invention there is provided an electrorheological fluid, which comprises an electrically insulating liquid and alcohol-treated carbonaceous particles dispersed in the liquid.

DETAILED DESCRIPTION OF THE INVENTION

Dispersible carbonaceous particles for use in the present invention are finely pulverized products obtained by pulverizing carbonaceous materials or by making carbonaceous materials into fibers, followed by pulverization, and include, for example, various carbon-blacks; finely pulverized coals such as anthracite, bituminous coal, etc.; finely pulverized petroleum pitches obtained by heat treatment of petroleum heavy oils such as naphtha residue, asphalt, fluidized catalytic cracking residue oil, etc.; finely pulverized coal pitches obtained by heat treatment of coal heavy oils such as coal tar, etc.; finely pulverized carbides of paraffins, olefins, etc. having 15 to about 20 carbon atoms; finely pulverized carbides of low molecular weight aromatic compounds such as naphthalene, biphenyl, etc.; finely pulverized carbides of polymers obtained by carbonizing polymers such as polyethylene, polymethylacrylate, polyvinyl chloride, phenol resin, polyacrylonitrile, etc.

Dispersible carbonaceous particles for use in the present invention also include mesophase microspheres obtained by mesophase (liquid crystal) conversion of such carbonaceous materials as petroleum pitches, coal pitches, carbides of polyvinyl chloride, etc. or particles containing the mesophase microspheres. Mesophare microspheres can be isolated as insoluble in a solvent such as quinoline, etc. Dispersible carbonaceous particles obtained particularly from petroleum pitches or coal pitches can be preferably used.

The dispersible carbonaceous particles have a particle size of 0.01 to 500 μm, preferably 1.0 to 100 μm. Below 0.01 μm, no sufficient electrorheological effect is obtained, whereas above 500 μm no satisfactory dispersion stability is obtained.

The dispersible carbonaceous particles for use in the present invention also include dispersible carbonaceous particles having a shape anisotropy, obtained by making carbonaceous materials that can be spun into fibers, for example, petroleum pitches, coal pitches, carbides of polycarylonitrile, etc., into fibers, followed by pulverizing the resulting fibers. The dispersible carbonaceous particles having a shape anisotropy are dispersible carbonaceous particles having a rod-like or whisker-like shape, 0.02 to 10,000 μm, preferably 10 to 5,000 μm in length, 0.01 to 500 μm, preferably 1.0 to 100 μm in diameter and 2 to 1,000,000, preferably 2 to 100,000, more preferably 3 to 10,000 in aspect ratio. When the dispersible carbonaceous particles having a shape anisotropy has a diameter of less than 0.01 μm, no sufficient electrorheological effect is obtained, whereas when they have a diameter of more than 500 μm, no satisfactory dispersion stability is obtained (according to a standing sedimentation test for several hours). When the dispersible carbonaceous particles having a shape anisotropy have a length of less than 0.02 μm, no sufficient electrorheological effect is obtained, whereas when they have a length of more than 10,000 μm, no satisfactory dispersion stability is obtained. When the dispersible carbonaceous particles having a shape anisotropy have an aspect ratio of less than 2, no sufficient electrorheological effect is obtained, whereas when they have an aspect ratio of more than 1,000,000, the initial viscosity is considerably large without application of an electrical field. This is not particularly preferable.

The dispersible carbonaceous particles can be provided with a shape anisotropy in several manners, for example, by spinning the carbonaceous particles into fibers by well known dry or wet spinning process or melt spinning process and pulverizing the resulting fibers in a mixer, or example, Henschel mixer or the like. Whisker-shaped carbonaceous particles can be obtained by subjecting hydrocarbons having 1 to 9 carbon atoms to gas phase pyrolysis in hydrogen in the presence of a metallic catalyst. In this case, the Whisker-shaped carbonaceous particles are subjected to an acid treatment.

It seems that the reason why the electrorheological effect is increased with the dispersible carbonaceous particles having a shape anisotropy is that an aligned structure can be more readily obtained than with spherical or block-shaped particles.

In the present invention, dispersible carbonaceous particles having a shape anisotropy are preferably used as dispersible carbonaceous particles.

In the present invention, dispersible carbonaceous particles subjected to an oxidation treatment with an oxidizing gas such as oxygen, ozone, air, nitrogen oxides, halogen, sulfur dioxide, etc. can be used.

The dispersible carbonaceous particles can be oxidized according to well known oxidation procedures. For example, the dispersible carbonaceous particles can be slowly oxidized with an oxidizing gas such as oxygen, ozone, air, nitrogen oxides, halogen, sulfur dioxide hydrocarbon solvent at a temperature of 10° to 400° C., preferably 20° to 350° C. usually for 0.1 minute to 10 hours.

In the first aspect of the present invention, the acid for use in the treatment of the carbon particles with an acid includes inorganic and organic acids. Inorganic acids include, for example, nitric acid, hydrochloric acid, sulfuric acid, a liquid mixture of potassium permanganate and sulfuric acid, phosphoric acid, an aqueous NaClO solution, chromic acid, etc. Organic acids include, for example, formic acid, acetic acid, propionic acid, malonic acid, etc. Among these acid, particularly inorganic acids, more particularly nitric acid, can considerably improve the electrorheological effect.

Inorganic acids are usually used in the form of an aqueous solution or in a fuming state. Particularly, the aqueous solution is easier to handle. In case of an aqueous solution the inorganic acid has a concentration of preferably 0.01N or more, more preferably 0.01 to 15N, most preferably 0.1 to 8N. Below 0.01N, the acid treatment is not satisfactory.

In case of organic acids, they are used in the form of an aqueous solution or a solution in an organic solvent. In this case, the organic acid also has a concentration of preferably 0.01N or more, more preferably 0.01 to 15N, most preferably 0.1 to 8N.

The dispersible carbonaceous particles are treated with the acid usually by mixing the dispersible carbonaceous particles with an acid solution with stirring. In case of petroleum pitch, coal pitch, carbides of polyacrylonitrile, etc. that can be spun into fibers, fibers can be made at first and than the resulting fibers can be subjected to an acid treatment and then to fine pulverization of the acid-treated fibers to a particulate state.

An acid treatment temperature is preferably in a range of −40° C. to 250° C. Below −40° C. the acid treatment is not satisfactory, whereas above 250° C. there is a possibility for an abrupt heat release. This is not preferable.

After the acid treatment, water washing and drying are carried out sufficiently, whereby acid-treated dispersible carbonaceous particles can be obtained.

After the acid treatment, further treatment with an aqueous solution of an alkali such as sodium hydroxide, etc. can be carried out. Particularly in case of treatment with sulfuric acid, the further treatment is effective.

Furthermore, before or after the acid treatment the dispersible carbonaceous particles can be fired at 100° to 800° C. in an inert gas.

In seems that the reason why the electrorheological effect is increased by the acid treatment is that polar groups are formed on the surfaces of dispersible carbonaceous particles by the acid treatment, thereby promoting surface polarization of the particles in an electric field.

In the second aspect of the present invention, the dispersible carbonaceous particles are treated with iodine usually by mixing the dispersible carbonaceous particles with an iodine solution with stirring. In case of petroleum pitch, coal pitch, carbides of polyacrylonitrile, etc. that can be spun into fibers, fibers can be made and then the resulting fibers can be subjected to the iodine treatment and then to fine pulverization of the iodine-treated fibers to a particulate state.

After the iodine treatment, water washing and drying are carried out sufficiently, whereby iodine-treated dispersible carbonaceous particles can be obtained.

Before or after the iodine treatment the dispersible carbonaceous particles can be subjected to an infusibilization treatment or an acid treatment. Furthermore, before or after the iodine treatment the dispersible carbonaceous particles can be fired at 100° to 500° C. in an inert gas.

In seems that the reason why the electrorheological effect is increased by the iodine treatment is that iodine is diffused into the dispersible carbonaceous particles by the iodine treatment, thereby forming charge transfer complexes, and thus transfer of electrons in an electric field can be readily occasioned, thereby promoting polarization.

Iodine is used in a solution in an organic solvent such as ethanol, etc., but the iodine treatment can be carried out in a solid state by sublimation. In case of an iodine solution, the solution has an iodine concentration of preferably 0.01N or more, more preferably 0.03 to 5N. Below 0.01N the iodine treatment is not satisfactory.

An iodine treatment temperature is preferably in a range of −50° to 300° C., more preferably 0° to 120° C. Below −50° C. the iodine treatment is not satisfactory, whereas above 300° C. there is a possibility for an abrupt heat release. This is not preferable.

In the third aspect of the present invention the current density can be lowered by coating the iodine-treated dispersible carbonaceous particles with an electrically insulating film. Such an electrically insulating film can be formed by coating the particles from a polymer solution, by surface treatments such as hybridization comprising dry mixing particles of small diameters and melting the resulting mixture on the surfaces of the dispersible carbonaceous particles, silane treatment, etc.; sputtering; vacuum vapor deposition; polymerization from monomers, etc.

Materials for use as the electrically insulating film according to the third aspect of the present invention include, for example, synthetic polymer materials such as polyethylene, polystyrene, polymethyl methacrylate, polyvinyl acetate, polyvinyl chloride, sodium polyacrylate, expoxy resin, phenol resin, urethane resin, etc.; silane-based treating agents such as tetraethoxysilane, methyltrimethoxysilane, phenyltrimethoxysilane, hexamethyldisilazane, trimethylchlorosilane, etc.; modified silicone oils in dimethylpolysiloxane or phenylmethylpolysiloxane structure as their main chain with carboxyl groups or hydroxyl groups; and inorganic compounds such as silica, alumina, rutile, etc.

The electrically insulating film has a thickness of preferably 0.005 to 30 μm, more preferably 0.01 to 3 μm. Below 0.005 μm the effect of the insulting film is not satisfactory, whereas above 30 μm no electrorheological effect is obtained.

In the fourth aspect of the present invention, the dispersible carbonaceous particles are treated with alcohol. Alcohol-treated dispersible carbonaceous particles can be usually prepared by mixing dispersible carbonaceous particles with an alcohol solution at room temperature with stirring, thereby conducting the alcohol treatment and then filtering and drying the alcohol-treated particles.

In case of petroleum pitch, coal pitch, carbides of polyacrylonitrile, etc. that can be spun into fibers, fibers can be made at first and then the resulting fibers can be subjected to an alcohol treatment, or after pulverization of the fibers the pulverized fibers can be subjected to the alcohol treatment.

An alcohol treatment temperature is in a range of preferably −50° to 200° C., more preferably 0° to 100° C. Below −50° C. the alcohol treatment is not satisfactory, whereas above 200° C. there is a possibility for an abrupt heat release. This is not preferable.

An alcohol treatment time is in a range of preferably 0.1 minute to 10 hours, more preferably 1 minute to 3 hours. Below 0.1 minute the alcohol treatment is not satisfactory, whereas above 10 hours there is a possibility for lowering of the electrorheological effect.

Alcohol for use in the alcohol treatment of dispersible carbonaceous particles include saturated and unsaturated alcohols. From the viewpoint of drying the alcohol-treated dispersible carbonaceous particles alcohols having 1 to 4 carbon atoms with a low boiling point are preferable, and particularly ethanol and 2-propanol are more preferable.

The effect of alcohol treatment is remarkable when applied to the acid-treated dispersible carbonaceous particles and a large electrorheological effect can be obtained by preventing deposition of the particles onto the electrode. Particularly a large effect can be obtained by applying the alcohol treatment to the acid-treated dispersible carbonaceous particles only after water-washing without drying.

The electrically insulating liquid for use in the present invention includes hydrocarbon solvents such as mineral oil, alkylnaphthalene, poly α-olefin, etc.; ester oils such as butyl phthalate, butyl sebatate, etc.; ether oils such as oligophenylene oxide, etc., silicone oils, foluorocarbon oils, etc.

A ratio of the carbonaceous particles to the electrically insulating liquid in an electrorheological fluid is 1 to 60:99 to 40% by weight, preferably 5 to 50:95:50% by weight. When the carbonaceous particles are less than 1% by weight, no sufficient electrorheological effect is obtained, whereas when they exceed 60% by weight, the initial viscosity is considerably large without application of an electrical field. This is not practically preferable.

Other dispersible particles, a dispersant such as a surfactant, etc. can be added to the present electrorheological fluid as additives in such a range as not to deteriorate the electrorheological effect of the present electrorheological fluid.

In some cases the electrorheological effect can be enhanced by adding a small amount of water thereto, but there are such problems as easier passage of electric current, narrowing of applicable temperature range, etc.

The present electrorheological fluid can show a distinguished electrorheological effect in a water-free system, and can be used in the fields of engine mounts, shock absorbers, clutches, torque converters, brake systems, power steering, valves, dampers, actuators, vibrators, etc.

PREFERRED EMBODIMENTS OF THE INVENTION

The present invention will be described in detail below, referring to Examples, which show embodiments of the present invention and are not limitative of the present invention.

SYNTHESIS EXAMPLE 1

Heavy oil having a boiling point of 320°–550° C., obtained by fluidized catalytic cracking of desulfurized vacuum gas oil of Arabian origin at 500° C. with a silica-alumina-based catalyst was subjected to heat treatment at a temperature of 430° C. under a pressure of 15 kg f/cm·G for 3 hours. The heat-treated oil was distilled at 250°/1 mmHg to remove light fractions, whereby a pitch (1-I) having a softening point of 98° C. was obtained.

Then, the pitch (1-I) was subjected to heat treatment in a nitrogen gas atmosphere at a temperature of 400° C. for 12 hours, whereby a pitch (1-II) having a softening point of 268° C. was obtained.

The pitch (1-II) was found by elemental analysis to have a carbon content of 95% by weight and a hydrogen content of 5% by weight.

Then, the pitch (1-II) was finely pulverized to obtain pitch particles (1-I) having particle sizes of 11 μm.

15 g of the pitch particles (1-I) were mixed with 150 ml of 5N nitric acid at room temperature for 5 hours with stirring. Then, the acid-treated particles were recovered by filtration, washed with water 5 times and finally dried at 80° C./2 mmHg for 5 hours, whereby the acid-treated pitch particles (1-2) were obtained.

The pitch particles (1-2) were found by elemental analysis to have a carbon content of 88% by weight, a hydrogen content of 5% by weight, an oxygen content of 4% by weight and a nitrogen content of 3% by weight.

SYNTHESIS EXAMPLE 2

Coal pitch was heat treated in a nitrogen gas atmosphere at 450° C. to obtain pitch (2-I) containing mesophase microspheres. Then, pitch particles (2-I) composed of mesophase microspheres were recovered from the pitch (2-1) by quinoline extraction.

The pitch (2-1) was found by elemental analysis to have a carbon content of 96% by weight, a hydrogen content of 3% by weight, and a nitrogen content of 1% by weight.

The pitch (2-1) was treated with 5N nitric acid in the same conditions as in Synthesis Example 1, whereby pitch particles (2-2) were obtained.

The pitch particles (2-2) were found by elemental analysis to have a carbon content of 87% by weight, a hydrogen content 3% by weight, nitrogen content of 4% by weight and oxygen content of 6% by weight.

SYNTHESIS EXAMPLE 3

The pitch (1-II) obtained in Synthesis Example 1 was spun into fibers, 15 μm in diameter, at 315° C. through a spinner, 3 mm in nozzle diameter with L/D=2, and then the fibers were pulverized in a Henschel mixer for 3 seconds to obtain pitch particles (3-1) having a shape anisotropy. The pitch particles (3-1) were in a rod shape having a diameter of 15 μm and an aspect ratio of 3 to 50.

The pitch particles (3-1) were treated with 5N nitric acid in the same conditions as in Synthesis Example 1, whereby pitch particles (3-2) having a shape anisotropy were obtained.

It was found by elemental analysis that the pitch particles (3-2) had a carbon content of 89% by weight, a hydrogen content of 4% by weight, an oxygen content of 4% by weight and a nitrogen content of 3% by weight.

EXAMPLES 1 TO 3 AND COMPARATIVE EXAMPLES 1 TO 3

3 g each of the pitch particles (1-2), (2-2) and (3-2), obtained in Synthesis Examples 1, 2, 3, respectively, were dispersed each in 7 g of silicone oil KF-96 (trademark of a product made by Shinetsu Silicone co., Ltd., Japan) having a viscosity of 20 cSt to prepare electrorheological fluids (1), (2) and (3).

Electrorheological fluids (4) and (5) were prepared from the pitch particles (1-1) obtained in Synthesis Example 1 and from the pitch particles (2-1) obtained in Synthesis Example 2, respectively, in the same manner as above.

Separately, 3 g of silica particles having a particle size of 15 μm were dispersed in 7 g of silicone oil KF-96 (trademark of a product made by Shinetsu Silicone Co., Ltd., Japan) having a viscosity of 20 cSt, and 0.3 g of water was added thereto to prepare an electrorheological fluid (6).

Then, torque values of the electrorheological fluids (1) to (6) were measured at temperatures of 25° C., 70° C. and 110° C., an applied voltage of 3 kV/mm and a shearing rate of 400 $s^{-1}$ in a double cylinder type, rotational viscometer with an inner cylinder diameter of 16 mm and an outer cylinder diameter of 18 mm, provided with an electric field-applying unit. At the same time electric currents were measured. The results are shown in Table 1, where the torque value was obtained as a difference between the torque before the application of an electric field and that after the application of the electric field.

TABLE 1

Electrorheological effect of acid-treated dispersible carbonaceous particles

| | Dispersible particles | Electrorheological fluid | Torque value g · cm | | | Current value μA | | |
|---|---|---|---|---|---|---|---|---|
| | | | 25° C. | 70° C. | 110° C. | 25° C. | 70° C. | 110° C. |
| Ex. 1 | (1-2) (Syn. Ex. 1) | (1) | 139.8 | 161.4 | 169.9 | 47.6 | 132.6 | 151.3 |
| Ex. 2 | (2-2) (Syn. Ex. 2) | (2) | 148.2 | 168.7 | 173.5 | 54.4 | 168.3 | 183.6 |
| Ex. 3 | (3-2) (Syn. Ex. 3) | (3) | 189.2 | 195.2 | 206.0 | 51.0 | 146.2 | 171.7 |
| Comp. Ex. 1 | (1-1) (Syn. Ex. 1) | (4) | 24.1 | 26.5 | 31.3 | 35.7 | 93.5 | 100.3 |
| Comp. Ex. 2 | (2-1) (Syn. Ex. 2) | (5) | 44.6 | 47.0 | 50.6 | 44.2 | 105.4 | 112.2 |
| Comp. Ex. 3 | Silica particles | (6) | 47.0 | 47.0 | 0.0 | 302.6 | 1659.2[1)] | 3.4 |

Note: [1)]Short circuit occurred one minute after the application of the electric field.

From the results of Examples 1 to 3 and Comparative Examples 1 to 3 it can be seen that:

(1) Electrorheological fluids using acid-treated dispersible carbonaceous particles as dispersible particles of the present invention have a larger electrorheological effect than those using untreated dispersible carbonaceous particles.

(2) As compared with the electrorheological fluid using silica particles and water, the present electrorheological fluids have a large electrorheological effect with less passage of electric current. Particularly, a difference in easiness of electric current passage at 70° C. is remarkable.

(3) The electrorheological fluid using silica particles has a considerably lowered shearing stress at 110° C. due to evaporation of water, whereas the present electrorheological fluids using acid-treated dispersible carbonaceous particles have a high shearing stress.

SYNTHESIS EXAMPLE 4

Heavy oil having a boiling point of 320° to 550° C., obtained by fluidized catalytic cracking of desulfurized vacuum light oil of Arabian origin at 500° C. with a silica-alumina-based catalyst was subjected to heat treatment at a temperature of 430° C. under a pressure of 15 kg f/cm·G for 3 hours. The heat-treated oil was distilled at 250° C./1 mmHg to remove light fractions, whereby pitch (1'-I) having a softening point of 98° C. was obtained.

Then, the pitch (1'-I) was subjected to heat treatment at a temperature of 400° C. for 12 hours, while passing a nitrogen gas therethrough, whereby pitch (1'-II) having a softening point of 268° C. was obtained.

It was found by elemental analysis that the pitch (1'-II) had a carbon content of 95% by weight and a hydrogen content of 5% by weight.

Then, the pitch (1'-II) was finely pulverized, whereby pitch particles (1'-1) having particle sizes of 11 μm were obtained.

50 g of the pitch particles (1'-1) were mixed with 2.5 g of iodine in 200 ml of ethanol (0.05N) at room temperature for 5 hours with stirring. Then, the iodine-treated pitch particles were recovered by filtration, washed with ethanol and finally dried at 80° C./2 mmHg for 5 hours, whereby iodine-treated pitch particles (1'-2) were obtained.

It was found by elemental analysis that the pitch particles (1'-2) had a carbon content of 90% by weight, a hydrogen content of 6% by weight and an iodine content of 4% by weight.

SYNTHESIS EXAMPLE 5

Coal pitch was heat treated in a nitrogen gas atmosphere at 450° C. to obtain pitch (2'-I) containing mesophase microspheres. Then, pitch (2'-1) composed of mesophase microspheres were recovered from the pitch (2'-I) by quinoline extraction.

The pitch (2'-1) was found by elemental analysis to have a carbon content of 96% by weight, a hydrogen content of 3% by weight, and a nitrogen content of 1% by weight.

The pitch (2'-1) was treated with iodine in the same conditions as in Synthesis Example 4, whereby pitches particles (2'-2) were obtained.

The pitch (2'-2) was found by elemental analysis to have a carbon content of 89% by weight, a hydrogen content 6% by weight, and iodine content of 5% by weight.

SYNTHESIS EXAMPLE 6

The pitch (1'-II) obtained in Synthesis Example 4 was spun into fibers, 15 μm in diameter, at 315° C. through a spinner, 3 mm in nozzle diameter with L/D=2, and then the fibers were pulverized in a Henschel mixer for 3 seconds to obtain pitch particles (3'-1) having a shape anisotropy. The pitch particles (3'-1) were in a rod shape having a diameter of 15 μm and an aspect ratio of 3 to 50.

The pitch particles (3'-1) were treated with iodine in the same conditions as in Synthesis Example 4, whereby pitch particles (3'-2) had a carbon content of 90% by weight, a hydrogen content of 6% by weight and an iodine content of 4% by weight.

SYNTHESIS EXAMPLE 7

10 g of the pitch particles (3'-2) subjected to the iodine treatment in Synthesis Example 6 were mixed in 500 ml of an aqueous solution of 0.2 wt. % sodium polyacrylate (degree of polymerization: 22,000 to 70,000) at room temperature for 8 hours with stirring. Then, the solution was reprecipitated in 3 l of ethanol, and the resulting coated particles were recovered by filtration, washed with ethanol and finally dried at 80° C./2 mmHg for 5 hours, whereby sodium polyacrylate-coated, iodine-treated pitch particles (3'-3) were obtained.

SYNTHESIS EXAMPLE 8

1 g of polyethylene was dissolved into 500 ml of dehydronaphthalene at 110° C., and 10 g of the iodine-treated pitch particles (3'-2), obtained in Synthesis Example 6, was added to the resulting solution and mixed therein at 110° C. for 5 minutes and then at room temperature for 2 hours with stirring. Then, the resulting coated particles were recovered by filtration, washed and finally dried at 80° C./2 mmHg for 5 hours, whereby polyethylene-coated, iodine-treated pitch particles (3'-4) were obtained.

SYNTHESIS EXAMPLE 9

10 g of the iodine-treated pitch particles (3'-2), obtained in Synthesis Example 6, were added to a solution containing 17.3 g of tetraethoxysilane in 50 g of ethanol, and further 2 ml of an aqueous 1.5N ammonia solution was added thereto with stirring. Immediately after the addition, particles were formed, and the reaction was continued thereafter at 80° C. for 5 hours to complete the sol-gel reaction to form silica. After the end of reaction, the resulting particles were dried at 80° C./2 mmHg, whereby silica-coated, iodine-treated pitch particles (3'-5) were obtained.

EXAMPLES 4 TO 9 AND COMPARATIVE EXAMPLES 4 TO 5

3 g each of the pitch particles (1'-2), (2'-2), (3'-2), (3'-3), (3'-4) and (3'-5) were dispersed each in 7 g of silicone oil KF-96 (trademark of a product made by Shinetsu Silicone Co., Ltd., Japan) having a viscosity of 20 cSt to prepare an electrorheological fluids (1') to (6').

Electrorheological fluids (7') and (8') were prepared from the pitch particles (1'-1) obtained in Synthesis Example 4 and from the pitch particles (2'-1) obtained in Synthesis Example 5 in the same manner as in Examples 4 to 9.

Then, torque values of the electrorheological fluids (1') to (8') were measured at temperature of 25° C., 70° C. and 110° C., an applied voltage of 3 kV/mm and a shearing rate of 400

$s^{-1}$ in a double cylinder type, rotational viscometer with an inner cylinder diameter of 16 mm and an outer cylinder diameter of 18 mm, provided with an electric field-applying unit. At the same time electric currents were measured. The results are shown in Table 2, where the torque value was obtained as a difference between the torque before the application of an electric field and that after the application of the electric field.

TABLE 2

| | Electrorheological effect of iodine-treated dispersible carbonaceous particles | | | | | | | |
|---|---|---|---|---|---|---|---|---|
| | Dispersible particles | Electrorheological fluid | Torque value g · cm | | | Current value μA | | |
| | | | 25° C. | 70° C. | 110° C. | 25° C. | 70° C. | 110° C. |
| Ex. 4 | (1'-2) (Syn. Ex. 4) | (1') | 155.4 | 171.3 | 175.9 | 52.4 | 140.8 | 158.3 |
| Ex. 5 | (2'-2) (Syn. Ex. 5) | (2') | 160.2 | 171.3 | 180.5 | 61.1 | 175.2 | 190.1 |
| Ex. 6 | (3'-2) (Syn. Ex. 6) | (3') | 215.7 | 226.2 | 230.1 | 75.4 | 182.3 | 211.3 |
| Ex. 7 | (3'-3) (Syn. Ex. 7) | (4') | 209.8 | 221.3 | 224.6 | 42.5 | 132.1 | 148.7 |
| Ex. 8 | (3'-4) (Syn. Ex. 8) | (5') | 220.8 | 228.9 | 234.1 | 33.4 | 108.2 | 114.1 |
| Ex. 9 | (3'-5) (Syn. Ex. 9) | (6') | 198.6 | 220.1 | 221.8 | 20.8 | 84.6 | 97.6 |
| Comp. Ex. 4 | (1'-1) (Syn. Ex. 4) | (7') | 24.1 | 26.5 | 31.3 | 35.7 | 93.5 | 100.3 |
| Comp. Ex. 5 | (2'-1) (Syn. Ex. 5) | (8') | 44.6 | 47.0 | 50.6 | 44.2 | 105.4 | 112.2 |
| Comp. Ex. 3 | Silica particles | (6) | 47.0 | 47.0 | 0.0 | 302.6 | 1659.2[1)] | 3.4 |

Note: [1)]Short circuit occurred one minute after the application of the electric field.

From the results of Examples 4 to 9 and Comparative Examples 3 to 5 it can be said that:

(1) Electrorheological fluids using iodine-treated dispersible carbonaceous particles as dispersible particles of the present invention have a larger electrorheological effect than those using untreated dispersible carbonaceous particles.

(2) As compared with the electrorheological fluid using silica particles and water, the present electrorheological fluids have a large electrorheological effect with less passage of electric current. Particularly, a difference in easiness of electric current passage at 70° C. is remarkable.

(3) The electrorheological fluid using silica particles has a considerably lowered shearing stress at 110° C. due to evaporation of water, whereas the present electrorheological fluids using iodine-treated dispersible carbonaceous particles have a high shearing stress.

(4) It is obvious from the foregoing results that electrorheological fluids using iodine-treated dispersible carbonaceous particles have good high temperature characteristics. The electric current values can be much lowered by coating the iodine-treated dispersible carbonaceous particles with an electrically insulating film.

SYNTHESIS EXAMPLE 10

Heavy oil having a boiling point of 320°–550° C., obtained by fluidized catalytic cracking of desulfurized vacuum gas oil of Arabian origin at 500° C. with a silica-alumina-based catalyst was subjected to heat treatment at a temperature of 430° C. under a pressure of 15 kg f/cm·G for 3 hours. The heat-treated oil was distilled at 250°/1 mmHg to remove light fractions, whereby a pitch (1"-I) having a softening point of 98° C. was obtained.

Then, the pitch (1"-I) was subjected to heat treatment in a nitrogen gas atmosphere at a temperature of 400° C. for 12 hours, whereby a pitch (1"-II) having a softening point of 268° C. was obtained.

Then, the pitch (1"-II) was found by elemental analysis to have a carbon content of 95% by weight and a hydrogen content of 5% by weight.

Then, the pitch (1"-II) was finely pulverized to obtain pitch particles (1"-1) having particle sizes of 11 μm.

Then, 50 g of the pitch particles (1"-1) were mixed in 200 ml of ethanol at room temperature for 20 minutes with stirring. The ethanol-treated particles were recovered by filtration and successively dried at 80° C./2 mmHg, whereby ethanol-treated pitch particles (1"-2) were obtained.

SYNTHESIS EXAMPLE 11

The pitch (1"-II) obtained in Synthesis Example 10 was spun into fibers, 15 μm in diameter, at 315° C. through a spinner, 3 mm in nozzle diameter with L/D=2, heated at a rate of 1° C./minute in oxygen, and subjected to heat treatment at 320° C. for one hour and then the fibers were pulverized in a Henschel mixer for 30 seconds to obtain pitch particles (2"-1) having a shape anisotropy. The pitch particles (2"-1) were in a rod shape having a diameter of 15 μm and an aspect ratio of 3 to 50.

50 g of the pitch particles (2"-1) were mixed in 200 ml of ethanol at room temperature for 30 minutes with stirring. Then, the ethanol-treated particles were recovered by filtration and successively dried at 80° C./2 mmHg for 5 hours, whereby ethanol-treated pitch particles (2"-2) having a shape anisotropy were obtained.

SYNTHESIS EXAMPLE 12

50 g of the pitch particles (1"-1) obtained in Synthesis Example 10 were mixed with 500 ml of 5N nitric acid at room temperature for 7.5 hours with stirring. Then, the acid-treated particles were recovered by filtration, washed with water 7 times and dried at 80° C./2 mmHg for 5 hours, whereby nitric acid-treated pitch particles (3"-1) were obtained. Likewise, 50 g of the pitch particles (1"-1) obtained in Synthesis Example 10 were mixed with 500 ml of 5N nitric acid at room temperature for 7.5 hours with stirring. Then, the acid-treated particles were filtered and washed with 7 times and then were mixed in 500 ml of 2-propanol at room temperature for 15 minutes, and then the alcohol-treated particles were recovered by filtration and successively dried at 80° C./2 mmHg for 5 hours, whereby 2-propanol-treated, acid-treated pitch particles (3"-2) were obtained.

EXAMPLES 10 TO 12 AND COMPARATIVE EXAMPLES 6 TO 8

40 g each of the pitch particles (1"-2), (2"-2) and (3"-2), obtained in Synthesis Examples 10, 11 and 12, respectively, were dispersed each in 40 g of silicon oil KF-96 (trademark of a product made by Shinetsu Kagaku Co., Ltd., Japan) having a viscosity of 20 cSt for 2 hours, and then silicone oil was added thereto, whereby electrorheological fluids (1") to (3") having a particle concentration of 40% by weight were obtained.

Likewise, electrorheological fluids (4") to (6") were prepared from alcohol-untreated pitch particles (1"-1), (2"-1) and (3"-1), respectively, obtained in Synthesis Examples 10, 11 and 12, in the same manner as above.

Then, torque values of the electrorheological fluids (1") to (6") were measured at temperatures of 25° C., 70° C. and 110° C., an applied voltage of 3 kV/mm and a shearing rate of 400 $s^{-1}$ in a double cylinder type, rotational viscometer with an inner cylinder diameter of 16 mm and an outer cylinder diameter of 18 mm, provided with an electric field-applying unit. At the same time electric currents were measured. The results are shown in Table 3, where the torque value was obtained as a difference between the torque before the application of an electric field and that after the application of the electric field.

TABLE 3

Electrorheological effect of alcohol-treated dispersible carbonaceous particles

| | Dispersible particles | Electrorheological fluid | Torque value g · cm | | | Current value μA | | |
|---|---|---|---|---|---|---|---|---|
| | | | 25° C. | 70° C. | 110° C. | 25° C. | 70° C. | 110° C. |
| Ex. 10 | (1"-2) (Syn. Ex. 10) | (1") | 92.4 | 100.3 | 109.5 | 50.8 | 139.6 | 159.0 |
| Ex. 11 | (2"-2) (Syn. Ex. 11) | (2") | 158.2 | 169.6 | 178.4 | 62.1 | 173.2 | 191.1 |
| Ex. 12 | (3"-2) (Syn. Ex. 12) | (3") | 245.7 | 256.2 | 270.1 | 76.1 | 180.2 | 211.7 |
| Comp. Ex. 6 | (1"-1) (Syn. Ex. 10) | (4") | 51.1 | 55.3 | 60.8 | 36.0 | 92.9 | 101.1 |
| Comp. Ex. 7 | (2"-1) (Syn. Ex. 11) | (5") | 115.4 | 120.1 | 123.6 | 43.9 | 104.8 | 113.5 |
| Comp. Ex. 8 | (3"-1) (Syn. Ex. 12) | (6") | 148.7 | 150.2 | 153.9 | 66.4 | 170.85 | 190.7 |
| Comp. Ex. 3 | Silica particles | (6) | 47.0 | 47.0 | 0.0 | 302.6 | 1659.2[1)] | 3.4 |

Note: [1)]Short circuit occurred one minute after the application of the electric field.

From the results of Examples 10 to 12 and Comparative Examples 3 and 6 to 8 it can be seen that:

(1) Electrorheological fluids using alcohol-treated dispersible carbonaceous particles as dispersible particles of the present invention have a large electrorheological effect than those using alcohol-untreated dispersible carbonaceous particles.

(2) As compared with the electrorheological fluid using silica particles and water, the present electrorheological fluids have a larger electrorheological effect with less passage of electric current. Particularly, a difference in easiness of electric current passage at 70° C. is remarkable.

(3) The electrorheological fluid using silica particles has a considerably lowered shearing stress at 110° C. due to fluids using alcohol-treated dispersible carbonaceous particles have a high shearing stress.

(4) It is obvious from the foregoing results that electrorheological fluids using alcohol-treated dispersible carbonaceous particles have good temperature characteristics.

The present electrorheological fluid using acid, iodine or alcohol-treated dispersible carbonaceous particles or iodine-treated dispersible carbonaceous particles coated with an electrically insulated film can show a distinguished electrorheological effect in a water-free system, and can be used in the fields of engine mounts, shock absorbers, clutches, torque converters, brake systems, power steering, valves, dampers, suspension systems, actuators, vibrators, ink jet printers, etc.

What is claimed is:

1. An electrorheological fluid consisting essentially of 1–60% by weight of an electrically insulating liquid and 99–40% by weight of inorganic or organic acid-treated dispersible carbonaceous particles dispersed therein.

2. An electrorheological fluid according to claim 1, wherein the acid treated, dispersible carbonaceous particles dispersed therein have a shape anisotropy, 0.02 to 10,000 μm in length, 0.01 to 500 μm in diameter and 2 to 1,000,000 in aspect ratio.

3. An electrorheological fluid according to claim 1, wherein the inorganic acid is nitric acid.

* * * * *